US009916738B2

(12) United States Patent
Lashina et al.

(10) Patent No.: US 9,916,738 B2
(45) Date of Patent: Mar. 13, 2018

(54) DETECTION AND NOTIFICATION OF PRESSURE WAVES BY LIGHTING UNITS

(71) Applicant: PHILIPS LIGHTING HOLDING B.V., Eindhoven (NL)

(72) Inventors: Tatiana Aleksandrovna Lashina, Eindhoven (NL); Philip Steven Newton, Waalre (NL); Dzmitry Viktorovich Aliakseyeu, Eindhoven (NL); Jonathan David Mason, Waalre (NL); Bartel Marinus Van De Sluis, Eindhoven (NL); Tim Dekker, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/129,605

(22) PCT Filed: Mar. 17, 2015

(86) PCT No.: PCT/IB2015/051923

§ 371 (c)(1),
(2) Date: Sep. 27, 2016

(87) PCT Pub. No.: WO2015/145299

PCT Pub. Date: Oct. 1, 2015

(65) Prior Publication Data

US 2017/0178465 A1 Jun. 22, 2017

Related U.S. Application Data

(60) Provisional application No. 61/971,080, filed on Mar. 27, 2014.

(51) Int. Cl.
*G08B 23/00* (2006.01)
*G08B 1/08* (2006.01)
(Continued)

(52) U.S. Cl.
CPC ..... *G08B 1/08* (2013.01); *G08B 21/0208* (2013.01); *G08B 13/1672* (2013.01)

(58) Field of Classification Search
CPC ... G08B 1/08; G08B 21/0208; G08B 13/1672
See application file for complete search history.

(56) References Cited

U.S. PATENT DOCUMENTS 5,651,070 A * 7/1997 Blunt ..... G08B 1/08 340/407.1
2010/0265100 A1 10/2010 Jalbout et al.
(Continued)

FOREIGN PATENT DOCUMENTS

GB 2470616 A 1/2010
WO 2012160467 A1 11/2012
WO 2013080082 A2 6/2013

OTHER PUBLICATIONS

Lee, Younghyun, et al., "Acoustic Signal Based Abnormal Event Detection System With Multiclass Adaboost," 2013 IEEE International Conference on Consumer Electronics (ICCE) (2 Pages).
(Continued)

*Primary Examiner* — Erin File
(74) *Attorney, Agent, or Firm* — Meenakshy Chakravorty

(57) ABSTRACT

Methods and apparatus for detection and notification of pressure waves are described herein. A lighting unit (100) may include one or more light sources (104) such as LEDs, a pressure wave sensor (106), a communication interface (108), and a controller (102) operably coupled with the one or more LEDs, the pressure wave sensor, and the communication interface. In various embodiments, the controller may be configured to receive a signal from the pressure wave sensor, the signal representative of one or more pressure waves detected by the pressure wave sensor. The controller may be configured to determine, based on the signal received from the pressure wave sensor, that the
(Continued)

detected one or more pressure waves satisfy a predetermined criterion. The controller may be configured to transmit, to one or more remote lighting units via the communication interface, notification that the predetermined criterion has been satisfied.

18 Claims, 5 Drawing Sheets

(51) Int. Cl.
*G08B 21/02* (2006.01)
*G08B 13/16* (2006.01)

(56) References Cited

U.S. PATENT DOCUMENTS

| | | | | |
|---|---|---|---|---|
| 2011/0140635 | A1 | 6/2011 | Kim | |
| 2015/0120000 | A1* | 4/2015 | Coffey | H04L 12/2803 700/13 |
| 2016/0050738 | A1 | 2/2016 | Bulut et al. | |
| 2016/0092198 | A1* | 3/2016 | Vangeel | F24F 11/006 717/173 |
| 2016/0323969 | A1* | 11/2016 | Aliakseyeu | A63H 33/42 |

OTHER PUBLICATIONS

Bratukhin, Aleksey, et al., "Energy Aware Manufacturing Environments," Center for Integrated Sensor Systems, Danube University Krems, 2013 (8 Pages).

* cited by examiner

300

400

DETECTION AND NOTIFICATION OF PRESSURE WAVES BY LIGHTING UNITS

CROSS-REFERENCE TO PRIOR APPLICATIONS

This application is the U.S. National Phase application under 35 U.S.C. §371 of International Application No. PCT/IB2015/051923, filed on Mar. 17, 2015, which claims the benefit of U.S. Patent Application No. 61/971,080, filed on Mar. 27, 2014. These applications are hereby incorporated by reference herein.

TECHNICAL FIELD

The present invention is directed generally to lighting control. More particularly, various inventive methods and apparatus disclosed herein relate to detection and notification of pressure waves by lighting units.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Users often desire to be notified of the occurrence of pressure waves such as sound and ultrasonic waves when the users are not proximate to such pressure waves. For example, baby monitors enable parents to monitor their children while the parents are out of earshot. When a baby starts crying, parents can take appropriate action, such as feeding the baby or changing its diaper. However, such technology requires that parents acquire and deploy baby monitor equipment that does not serve many other obvious purposes, and which may decrease in usefulness as the child ages.

The capability exists to configure mobile computing devices such as smart phones and tablet computers to stand in as baby monitor transmitters and receivers, e.g., using WiFi. One device may stream audio and/or send notification (e.g., as a text message) of an audio event to another device. However, such technology may be cumbersome to set up, and a user may wish to use her smart phone or tablet computer for other purposes. Moreover, using baby monitors, smart phones and tablet computers as described above fails to take advantage of connected lighting infrastructure exists or may soon exist in nearly all homes or other buildings.

Thus, there is a need in the art to take advantage of connected lighting infrastructure this is or soon will be found in nearly all homes and other buildings to enable users to remotely monitor pressure waves.

SUMMARY

The present disclosure is directed to inventive methods and apparatus for detection and notification of pressure waves by lighting units. For example, a lighting unit equipped with a pressure wave sensor (e.g., a microphone or ultrasonic sensor) may be configured to act as a "listener," so that it may take various actions, such as notifying other lighting units, when it detects a pressure wave that satisfies a predetermined criterion. Additionally or alternatively, the same or a different lighting unit may be configured to act as a "follower," so that it may perform various actions when it receives a notification from a listener lighting unit, such as selectively energizing one or more light sources.

Generally, in one aspect, a lighting unit may include: one or more LEDs; a pressure wave sensor; a communication interface; and a controller operably coupled with the one or more LEDs, the pressure wave sensor, and the communication interface. The controller may be configured to: receive a signal from the pressure wave sensor, the signal representative of one or more pressure waves detected by the pressure wave sensor; determine, based on the signal received from the pressure wave sensor, that the detected one or more pressure waves satisfy a predetermined criterion; and transmit, to one or more remote lighting units via the communication interface, notification that the predetermined criterion has been satisfied.

In various embodiments, the predetermined criterion may include an audio threshold. In various embodiments, the predetermined criterion may include a predetermined pressure wave profile associated with a particular event. In various versions, the predetermined pressure wave profile may be associated with a baby crying. In various embodiments, the predetermined pressure wave profile may be associated with actuation of a doorbell or breaking glass.

In various versions, the signal may be a local signal, and the controller may be further configured to subtract, from the local signal prior to the determination, one or more remote signals. The one or more remote signals may be received via the communication interface from one or more remote lighting units and are representative of the one or more pressure waves as detected by the one or more remote lighting units.

In various versions, the controller may be configured to: stream another signal representative of the detected pressure wave to a remote computing device via the communication interface, and receive, from the remote computing device via the communication interface, an indication that the signal from the pressure wave sensor satisfies one or more predetermined pressure wave profiles.

In various embodiments, the pressure wave sensor may include an ultrasonic sensor. In various versions, the predetermined criterion may include an ultrasonic threshold. In various embodiments, the lighting unit may include a presence sensor coupled with the controller. The controller may be configured to selectively energize the one or more LEDs responsive to the determination that the detected one or more pressure waves satisfy the predetermined criterion and a signal from the presence sensor.

In various embodiments, the controller may be configured to transmit the notification to at least one smart phone or tablet computer. In various versions, the notification may include a short message service (SMS) message. In various versions, the controller may be configured to transmit the notification to the at least one smart phone or tablet computer responsive to a determination that no remote lighting units detected presence of a person within a predetermined time interval of the one or more detected pressure waves.

In various embodiments, the controller may be configured to cause a time-stamped entry to be stored in an event log in response to the determination that the predetermined criterion is satisfied. In various embodiments, the predetermined criterion may include a predetermined pressure wave profile associated with indoor noise. In various embodiments, the lighting unit may include a speaker. The controller may be configured to cause the speaker to emit audio output responsive to the determination that the predetermined criterion is satisfied.

In another aspect, a lighting unit may include: one or more LEDs; presence sensor; a communication interface; and a controller operably coupled with the one or more LEDs, the presence sensor, and the communication interface. The controller may be configured to: receive, from a remote lighting unit via the communication interface, notification that a predetermined criterion has been satisfied by one or more pressure waves detected by the remote lighting unit; and selectively energize the one or more LEDs in response to receipt of the notification and a signal from the presence sensor. In various embodiments, the lighting unit may include a speaker. The controller may be configured to provide audible output through the speaker in response to receipt of the notification and the signal from the presence sensor.

In various embodiments, the controller may be further configured to: receive, from another remote lighting unit via the communication interface, a signal representing one or more pressure waves detected by the another remote lighting unit; and determine, using pattern matching, that the signal corresponds to a predetermined pressure wave profile. In various versions, the controller may be configured to selectively energize the one or more LEDs in response to the determination that the signal corresponds to a predetermined pressure wave profile. In various versions, the controller may be configured to transmit, to the another remote lighting unit via the communication interface, notification that the signal corresponds to the predetermined pressure wave profile.

In various embodiments, the controller may be configured to selectively energize the one or more LEDs in response to a determination that the lighting unit is a last lighting unit of a plurality of lighting units to receive a signal from its respective presence sensor.

In another aspect, a computer-implemented method may include: receiving, at a computing device from a remote lighting unit, a signal representative of one or more pressure waves detected by the remote lighting unit; determining, by the computing device using pattern matching, that the one or more pressure waves represented by the signal satisfy a predetermined criterion; and providing, by the computing device, notification of the determination.

In various embodiments, providing the notification may include transmitting the notification to a smart phone or tablet computer operated by a user. In various embodiments, the method may include facilitating, by the computing device or another computing device, audio playback of the pressure wave to a user and rendition of output that prompts the user to accept or reject the pressure wave as a predetermined pressure profile, subsequent satisfaction of which will cause notification to be provided to the user.

In various embodiments, the method may include storing the pressure wave profile in a pressure wave profile clearinghouse accessible to a plurality of users, responsive to the user accepting the pressure wave profile as one for which the user wishes to be notified.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial packaged LEDs, power packaged LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

As used herein, a "predetermined pressure wave profile" is a generic pressure wave pattern or series of pressure wave patterns that is associated with (e.g., caused by) a generic sonic or ultrasonic event (e.g., generic baby cries, generic doorbell, etc.). This pattern could include different auditory features as traditionally used in the auditory scene analysis method, such as amplitude modulations, spectral profile, amplitude onsets, rhythm, etc. Techniques such as pattern matching may be used to determine whether one or more pressure waves detected by a pressure wave sensor (e.g., a microphone) correspond to a particular pressure wave profile. A pressure wave need not exactly match a pressure wave profile in order to "correspond" to that profile. If pattern matching or other similar techniques reveal that a detected pressure wave signal matches a pressure wave profile with a predetermined level of certainty or tolerance, the detected pressure wave signal may correspond to the predetermined pressure wave profile. For instance, not every baby crying sounds the same. However, a detected pressure wave signal of a particular baby crying may correspond to a generic pressure wave profile associated with babies crying in general if pattern matching reveals that the recorded pressure wave signal matches the pressure wave profile with some predetermined level of certainty or tolerance. The greater amount of uncertainty permitted or the higher the tolerance, the more likely a detected pressure wave signal will correspond to a generic pressure wave profile.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Users often desire to be notified of the occurrence of pressure waves such as sound and ultrasonic waves, even when the users are located remotely from an event that causes the pressure waves. However, existing solutions may be cumbersome to set up and may hijack resources that a user wishes to use for other purposes. Moreover, these solutions fail to leverage connected lighting infrastructure that exists or soon is likely to exist in nearly all homes or other buildings. Thus, there is a need in the art to take advantage of connected lighting infrastructure to enable users to remotely monitor pressure waves.

More generally, Applicants have recognized and appreciated that it would be beneficial to enable remote monitoring of pressure waves using existing lighting infrastructure, equipped with lighting units and/or lighting fixtures described herein. In view of the foregoing, various embodiments and implementations of the present invention are directed to lighting units and methods of using lighting units for detection and notification of pressure waves.

Figure 1:
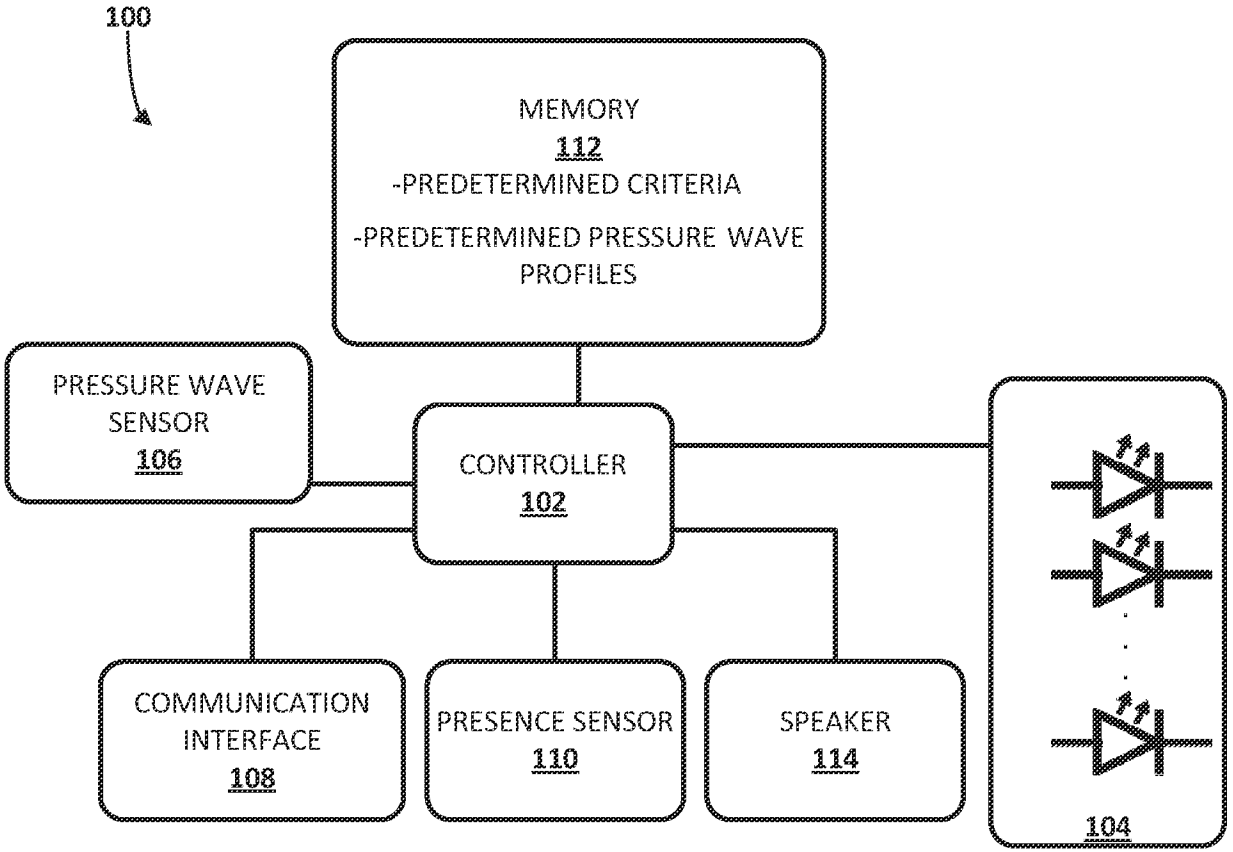
FIG. 1 schematically illustrates example components of a lighting unit, in accordance with various embodiments.

Referring to FIG. 1, an example lighting unit 100 may include a controller 102 coupled with one or more light sources, such as one or more light emitting diodes ("LEDs") 104. In various embodiments, controller 102 may be coupled with a pressure wave sensor 106. Pressure wave sensor 106 may be a device configured to detect pressure waves and to generate a signal representative of detected pressure waves. In various embodiments, pressure wave sensor 106 may include a microphone configured to detect and/or record audible sound. In some embodiments, pressure wave sensor 106 may additionally or alternatively include an ultrasonic sensor configured to detect pressure waves having wavelengths such that the pressure waves are not audible to humans. Although lighting units are described herein practicing selected aspects of the present disclosure, it is possible that other lighting apparatus, such as lighting fixtures, may be configured to practice selected aspects of the present disclosure.

Controller 102 may also be coupled with a communication interface 108. In various embodiments, communication interface 108 may include a wireless transmitter and/or receiver, or in many cases a transceiver. Communication interface 108 may be configured to wirelessly exchange data with remote devices such as other remote lighting units or remote computing devices such as lighting bridges, smart phones, tablet computers, laptop computers, set top boxes, desktop computers, and so forth. In some embodiments, communication interface 108 may be configured to exchange data with remote devices using wired technology as well. Communication interface 108 may employ various technologies to communicate with other devices, including but not limited to BlueTooth, ZigBee, WiFi (e.g., WiFi Direct), cellular, Ethernet, radio frequency identification ("RFID"), near field communication ("NFC"), and so forth.

In various embodiments, lighting unit 100 may include a presence sensor 110 configured to produce a signal indicative of a human presence nearby. For example, in some embodiments, presence sensor 110 may be a passive infrared ("PIR") sensor configured to produce a signal upon detecting when a person passes by and/or is near lighting unit 100. In other embodiments, pressure wave sensor 106 may also operate as presence sensor 106. For example, if pressure wave sensor 106 is a microphone, any sound that satisfies a predetermined audio threshold may cause pressure wave sensor 106 to provide a presence signal to controller 102.

In various embodiments, lighting unit 100 may include other components, such as memory 112 and/or a speaker 114. Memory 112 may be configured to store various information, such as predetermined pressure wave criteria, including pressure wave profiles associated with particular events and/or other data. Speaker 114 may be configured to emit sound as output. For instance, in some embodiments, controller 102 may cause speaker 114 to emit audio output in response to various pressure wave events, such as a baby crying. In some embodiments, lighting unit 100 may include other components not depicted in FIG. 1, including but not limited to a light sensor or an image capture device such as a camera (e.g., for sending or receiving coded light signals, or for streaming to a remote computing device a closed-circuit-like visual feed).

In various embodiments, lighting unit 100 may be configured to act as a "listener", meaning that the lighting unit is configured to detect pressure waves (e.g., sounds, ultrasonic waves), and to notify other devices, such as other lighting units, smart phones, tablets, or lighting system bridges, when the detected pressure waves satisfy some sort of predetermined criterion. For instance, controller 102 may be configured to receive a signal from pressure wave sensor 106. The signal may be representative of one or more pressure waves detected by pressure wave sensor 106. For example, if a sound occurs in a room in which lighting unit 100 is installed, pressure wave sensor 106 may detect the sound and provide a representative signal to controller 102.

Controller 102 may be configured to determine, based on the signal received from pressure wave sensor 106, whether the detected one or more pressure waves satisfy a predetermined criterion. For example, in some embodiments, the predetermined criterion may be an audio threshold, e.g., a minimum decibel level and/or duration that a detected sound must exceed before controller 102 will take further action. If a baby makes a soft and/or brief whimper, controller 102 may ignore it. If the baby cries loudly or for at least a predetermined time interval, controller 102 may take responsive action.

In addition to audio thresholds, in various embodiments, controller 102 may be configured to compare a signal provided by pressure wave sensor 106 representative of one or more detected pressure waves to one or more predetermined pressure wave profiles. If the detected signal corresponds to a particular pressure wave profile, controller 102 may determine that an event associated with that pressure wave profile has occurred, and make take appropriate action. Various generic events may be represented by predetermined pressure wave profiles, including but not limited to a baby crying, actuation of a doorbell, glass breaking, garage door opening, laughter (e.g., in a child's room after she is supposed to be sleeping), various pet noises, and so forth. Some pressure wave profiles may be highly generic and satisfied by a variety of sounds that loosely satisfy the profile. For instance, a pressure wave profile may be associated with indoor noise, such that virtually any noise made inside will satisfy the profile, whereas outdoor sounds may not.

Once controller 102 determines that the predetermined criterion (e.g., audio threshold or pressure wave profile) is satisfied, controller 102 may take various actions. In some embodiments, controller 102 may transmit, to one or more "follower" remote lighting units or other devices via communication interface 108, a notification that the predetermined criterion has been satisfied. In some embodiments, controller 102 may take other responsive actions as well, such as causing a time-stamped entry to be stored in an event log, e.g., in memory 112 or in memory of another lighting unit or computing device, selectively energizing one or more LEDs 104 (e.g., emitting a dynamic lighting effect or light having certain lighting properties), or causing speaker 114 to emit audio output.

In some embodiments, one or more detected pressure waves may be detected by multiple lighting units simultaneously. Each lighting unit make take various actions to increase its signal-to-noise-ratio to obtain a "cleaned" signal representative of the detected pressure wave. For example, in some embodiments, controller 102 may be configured to subtract, from a local signal received from pressure wave sensor 106, one or more remote signals received via communication interface 108 from one or more remote lighting units. The one or more remote signals may represent the same pressure waves detected locally by pressure wave sensor 106, accept from the perspectives of the one or more remote lighting units.

In some embodiments, one or more of the multiple "cleaned" signals at the multiple lighting units may be selected over others for determination of satisfaction of the predetermined criterion. For instance, a lighting unit that does not detect a user's presence nearby and yet detects the pressure waves more strongly than other lighting units may be a good candidate for having the signal most suitable for determining whether the predetermined criterion is satisfied. In some embodiments, the multiple signals may be used in combination with information about relative positions of the multiple lighting units to determine, e.g., a location of the sound or whether the sound is indoors or outdoors.

In some embodiments, controller 102 may lack sufficient computing resources to compare detected pressure waves to pressure wave profiles. In some such cases, controller 102 may be configured to "outsource" the comparison to one or more remote devices, such as another lighting unit, a smart phone or tablet computer, a lighting system bridge, a laptop or desktop computer, a remote server, the cloud, and so forth. For instance, controller 102 may be configured to stream another signal representative of the signal it receives from pressure wave sensor 106 to a remote computing device via communication interface 108. Controller 102 may then receive in response, from the remote computing device or another remote computing device via communication interface 108, an indication of whether the signal from pressure wave sensor 106 satisfies one or more predetermined pressure wave profiles.

As noted above, in some embodiments, pressure wave sensor 106 may be configured to detect ultrasonic waves that might not be audible to human ears. In some such embodiments, controller 102 may be configured to determine whether one or more ultrasonic pressure waves detected by pressure wave sensor 106 satisfy a predetermined criterion in the form of an ultrasonic threshold. In some embodiments, "active" sonar, not necessarily connected to the lighting unit 100, may be implemented in which a speaker 114 is configured to emit a pulse, and pressure wave sensor 106 "listens" for a response. In other embodiments, pressure wave sensor 106 may implement a "passive" sonar in which it simply listens for ultrasonic pressure waves. In some embodiments, ultrasonic detection may be used in conjunction with sonic detection, e.g., for presence detection.

In various embodiments, sonar may be used to detect changes in a monitored ultrasonic pulse. For instance, a speaker may be installed outside of a window and configured to emit ultrasonic pulses at various intervals or continuously. If the window is broken, pressure wave sensor 106 of an indoor lighting unit 100 may detect a variation (e.g., a tone increase) in the monitored ultrasonic pulse. In response, controller 102 of the indoor lighting unit 100 may notify one or more remote devices, such as a remote lighting unit and/or a smart phone or tablet computer, of the event, "broken window." That way the home owner may be notified of the broken window even when she is out of earshot of the broken window or is away from home.

In addition to or instead of acting as a "listener" lighting unit, lighting unit 100 may be configured to act as a "follower" lighting unit that receives notifications from listener lighting units (possibly facilitated by a computing device such as a tablet or a smart phone) about various pressure wave events. In some embodiments, follower lighting units 100 may be configured to selectively energize one or more LEDs 104 or emit sound from speaker 114 based on notifications received from remote lighting units. For instance, a mother may be notified that her baby in an upstairs bedroom is crying, e.g., by kitchen lighting units flashing or emitting some other predetermined lighting pattern or light having various predetermined lighting properties.

In various embodiments, follower lighting units may only provide a notification of a pressure wave event detected by a remote lighting unit if someone is present to receive the notification. For instance, in some embodiments, controller 102 of follower lighting unit 100 may be configured to selectively energize one or more LEDs 102 responsive to both a notification from a remote lighting unit that detected pressure waves satisfy a predetermined criterion, and a signal from presence sensor 110.

It is possible that no lighting unit of a lighting system detects a user's presence contemporaneously with detection of one or more pressure waves that satisfy a predetermined criterion. For instance, if a user has been immobile for some time, that user's presence may not be detected by motion-sensitive presence sensors 110 of nearby lighting units. In such a scenario, lighting units in a lighting system may be configured to communicate with each other to determine which lighting unit last detected a user's presence. A controller 102 of the last lighting unit 100 to receive a signal from its respective presence sensor 110 may be configured to selectively energize one or more LEDs 104 or emit sound from speaker 114. If a user is still nearby that last lighting unit, she will be in a position to consume the notification.

If no lighting unit has detected a user's presence for at least a predetermined time interval, it is likely that no user is present. In such a scenario, in some embodiments, one or more lighting units may transmit notification of the detected pressure waves to a remote computing device, such as a smart phone or tablet computer, e.g., using a short message service ("SMS") or multimedia messaging service ("MMS") message. That way, a user away from home may be notified of a pressure wave detected at her house that satisfies a predetermined criterion, and may take suitable action. In some embodiments, lighting units may be configured by a user to always transmit such notification to the smart phone or tablet computer, even where a user's presence is detected by one or more lighting units when pressure waves are detected.

As noted above, in some embodiments, in addition to or instead of selectively energizing one or more LEDs 104 in response to receipt of the notification, controller 102 may cause speaker 114 to provide audible output. For instance, if a lighting unit 100 near a baby's crib is acting as a follower and receives notification, e.g., from another lighting unit nearby, that the baby is crying, controller 102 may cause speaker 114 to emit soothing sounds (e.g., a lullaby, the parent's voice streamed from a remote device) to attempt to get the baby back to sleep. Similarly, a listener lighting unit near the crib that itself detects the baby crying may also cause its respective speaker 114 to emit a soothing sound in response to the detected pressure wave. In addition to soothing sounds, a controller 102 of a lighting unit near the crib may also selectively energize one or more LEDs 104, e.g., to create a soothing lighting dynamic to accompany the soothing sounds.

As noted above, in some embodiments, a follower lighting unit may be tasked by a remote lighting unit (e.g., if the follower lighting unit has superior computing resources) with analyzing a signal representative of a detected pressure wave to determine whether a predetermined criterion such as a pressure wave profile is satisfied. For instance, in a follower lighting unit 100, controller 102 may be further configured to receive, from another remote lighting unit via communication interface 108, a signal representing one or more pressure waves detected by the another remote lighting unit. Controller 102 may then determine, e.g., using pattern matching, that the received signal corresponds to a predetermined pressure wave profile. Controller 102 may then be configured to transmit, to the other remote lighting unit via communication interface 108, notification that the signal corresponds to the predetermined pressure wave profile.

In various embodiments, lighting unit 100 may configured as both a listener and a follower for use as a home security accessory. For instance, lighting unit 100 may be configured to determine whether a pressure wave detected by pressure wave sensor 106 matches a pressure wave profile associated with breaking glass. Additionally or alternatively, as described above, controller 102 may listen for a change in tone in an ultrasonic pulse from an outdoor emitter, where the change in pulse results from a window being broken or at least open. Either way, if presence sensor 110 detects a person's presence simultaneously or within a predetermined time interval of the glass breaking event, controller 102 may determine that a home security breach has occurred. Controller 102 may notify other lighting units 100 in the house, which in some cases may all light up in response, either automatically or if a person's presence is detected nearby. Controller 102 may also cause speaker to emit a loud sound, such as an alarm sound. Controller 102 may also transmit, via communication interface 108 to a smart phone or other computing device (e.g., in the house or at a security company), notification of the break in. In some embodiments, controller 102 may cause one or more networked security cameras, either integral with a lighting unit or elsewhere in the house, to begin recording, in the hope of capturing video of the perpetrator. In some cases, one or more cameras may be pointed in a direction of the detected pressure wave event, e.g., using acoustic location as described previously.

Other pressure wave events besides breaking glass may signify a home security breach. In some embodiments, whether a given event triggers an alarm may depend on one or more contextual cues. For instance, if a home owner's online calendar says they're out of town, and one or more lighting units 100 detect pressure waves and/or human presence in the household, the one or more lighting units 100 may raise an alarm and/or transmit notification to the homeowner's smart phone or tablet computer. As another example, predetermined pressure wave profiles associated with daytime-appropriate events (e.g., laughter, operation of one or more tools, conversation, sizzling, etc.) may not be applied by lighting unit 100 during daylight hours. However, during certain hours in the night, lighting unit 100 may determine whether detected pressure waves satisfy those predetermined pressure wave profiles, and may take various actions (e.g., turning on LEDs 104, notifying other lighting units) in response.

Figure 2:
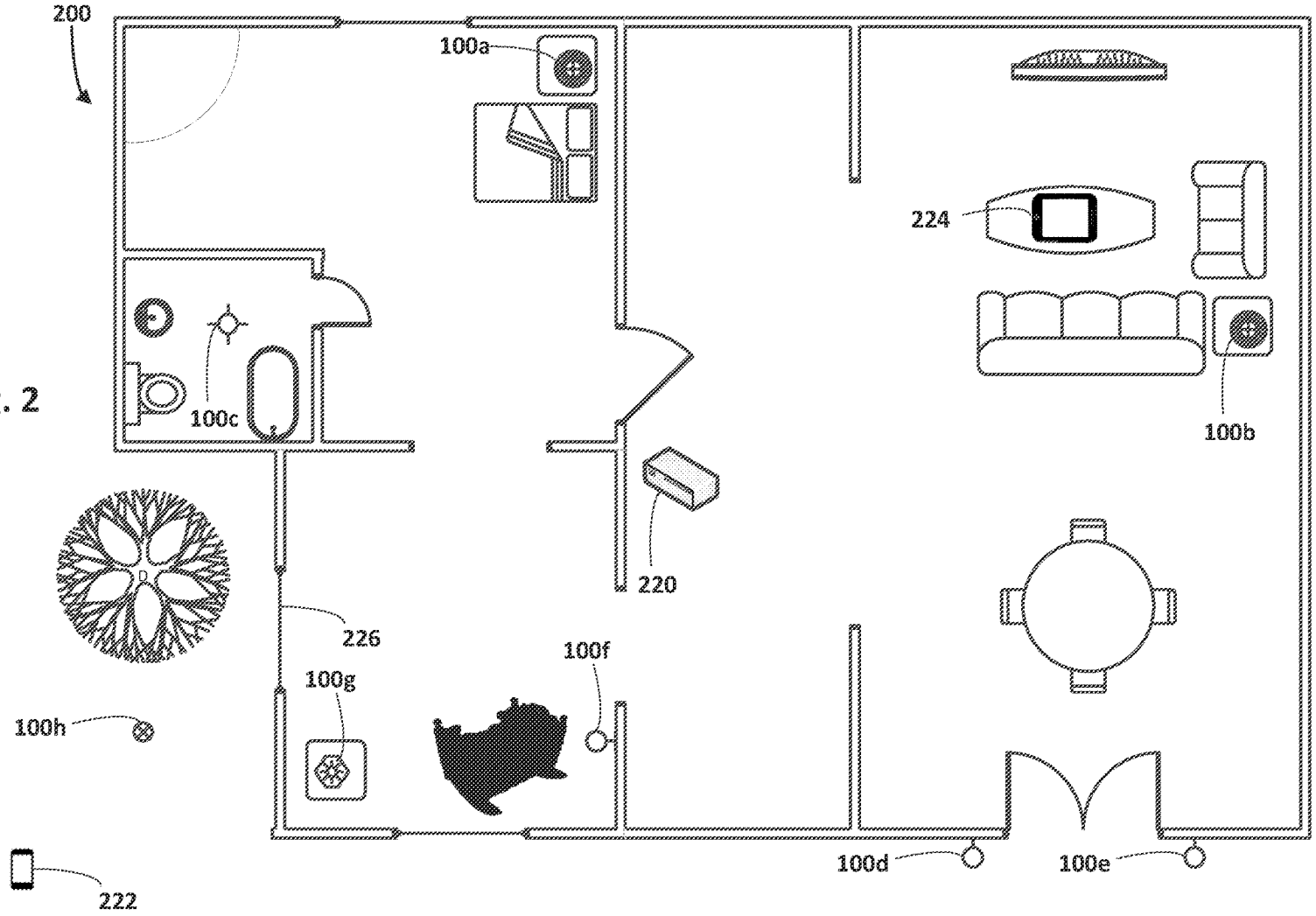
FIG. 2 schematically illustrates an example household with lighting units configured with selected aspects of the present disclosure, in accordance with various embodiments.

FIG. 2 depicts an example household 200 with a lighting system that includes a plurality of lighting units 100*a-h*. Lighting units are depicted installed adjacent a bed in a bedroom (100*a*), adjacent a couch in a living room (100*b*), in a bathroom (100*c*), outside a front door (100*d* and *e*), adjacent a baby's crib (100*f*), elsewhere in the baby's room (100*g*), and outside in the yard (100*h*). One or more of plurality of lighting units 100*a-h* may be equipped with one or more components depicted in FIG. 1. Any of plurality of lighting units 100*a-h* may be designated a "listener" and/or a "follower," e.g., manually via an app on the user smart device or in response to various contextual cues (e.g., time of day, user presence, weather, user activities, one or more calendars, etc.).

Also depicted in FIG. 2 is a lighting system bridge 220 that may be in communication with plurality of lighting units 100*a-h*, e.g., over a wireless network (e.g., WiFi) or via other means (e.g., Bluetooth, Zigbee, etc.). Lighting system bridge 220 may be configured to control and/or coordinate operation of one or more lighting units 100*a-h*. Also depicted are a smart phone 222 at some distance from household 200 and a tablet computer 224, which may be operated by a user to exchange data with lighting system bridge 220 and/or one or more of lighting units 100*a-h*. Smart phone 222 may be far enough from household 200 that it communicates with other components using cellular technology.

At nighttime, lighting unit 100*f* and/or lighting unit 100*g* may act as "listener" lighting units that monitor a baby sleeping in the depicted crib. When the baby cries out, the resulting pressure waves may be detected by respective pressure wave sensors 106 of these two lighting units. As mentioned above, in some embodiments, these lighting units may exchange recorded signals represented of the baby's cries from each other's perspective, so that they can subtract the other's signal from their own to improve a signal-to-noise ratio.

Assuming the pressure waves created from the baby's cries and detected by lighting units 100*g* and/or 100*h* satisfy a predetermined criterion, such as exceeding an audio threshold or satisfying a predetermined pressure wave profile associated with babies crying, one or both of lighting units 100*f-g* may transmit notification to one or more remote lighting units (e.g., 100*a-e* or *h*). In some embodiments, lighting units 100*f-g* may additionally or alternatively transmit a notification to lighting system bridge 220 and/or smart phone 222 or tablet computer 224, e.g., automatically or in the event it is determined that no one is home (in which case a text may be sent to smart phone 222).

For instance, assume a mother is watching a television in the living room (top right) and a father is in the bathroom while the baby is sleeping. Lighting unit 100*c* may detect the father's presence in the bathroom, so that when it receives the notification of the baby crying from lighting unit 100*f* or 100*g*, controller 102 of lighting unit 100*c* may selectively illuminate one or more LEDs 104 and/or emit sound from speaker 114, if present. Likewise, lighting unit 100*b* may detect, or may have detected within a predetermined time interval (e.g., the last five minutes), the mother's presence in the living room. On receipt of the notification from lighting unit 100*f* or *g*, controller 102 of lighting unit 100*b* may selectively illuminate its one or more LEDs 104 and/or cause its speaker 114 to emit a sound. Other lighting units, such as 100*a, d-e* and *h* may not have detected a user's presence within predetermined time intervals (which may be manually or automatically configured per lighting unit, e.g., based on contextual cues), and so may not perform any actions on receipt of notification of the baby crying from lighting units 100*f-g*.

As another example, assume lighting unit 100*h* has an ultrasonic speaker 114 that periodically or continuously emits an ultrasonic pulse. One or more indoor lighting units, such as lighting unit 100*g*, may be configured to monitor this pulse for any changes. In the event there is a variation, e.g., as a result of a window 226 being broken, lighting unit 100*g* may notify other lighting units, lighting system bridge 220 and/or smart phone 222 or tablet computer 224.

As yet another example, lighting units 100*d-e* may be configured to compare detected pressure waves to predetermined pressure wave profiles associated with various outdoor events, such as a car pulling into the driveway. Thus, when a car pulls into a driveway, lighting units 100*d-e* may notify other indoor lighting units 100*a-c* and *f*, lighting system bridge 220, and/or smart phone 222 or tablet computer 224. Lighting units 100*d-e* may additionally or alternatively emit light or sound responsive to the sound of the vehicle pulling into the driveway, e.g., so that passengers of the vehicle will have their path to the house lit. A car merely passing by on a road, on the other hand, may create a sound that does not satisfy a car-pulls-into-driveway predetermined pressure wave profile. In such case, lighting units 100*d-e* may not transmit notifications because the predetermined criteria (e.g., a predetermined pressure wave profile) is not satisfied.

Figure 3:
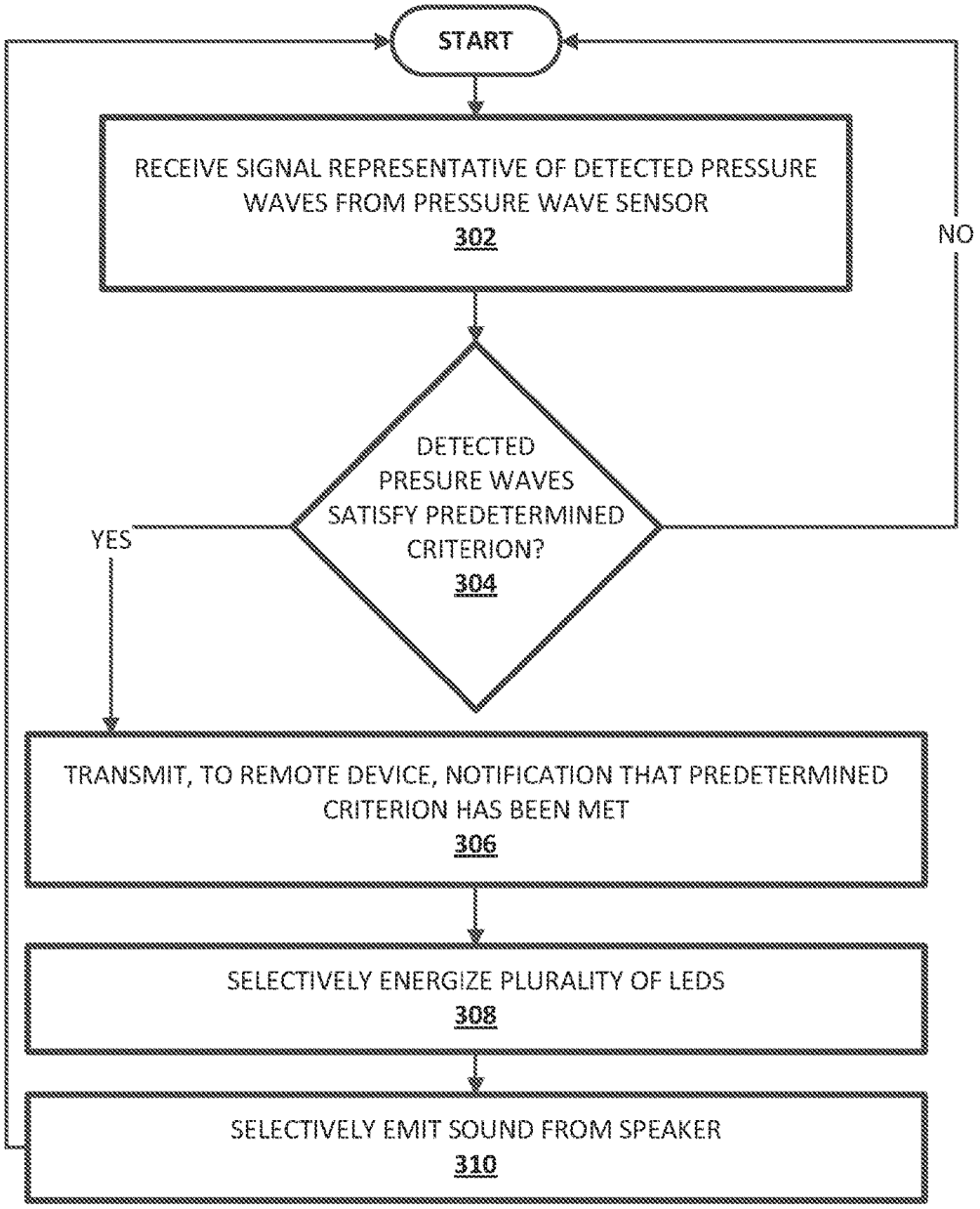
FIG. 3 depicts an example method of operating a lighting unit as a "listener," in accordance with various embodiments.

FIG. 3 depicts an example method 300 that may be implemented by controller 102 of lighting unit 100 acting as a "listener," in accordance with various embodiments. Although the operations in FIG. 3 and elsewhere are depicted in a particular order, this is not meant to be limiting, and various operations may be reordered, added or omitted. At block 302, a signal representative of one or more pressure waves detected by pressure wave sensor 106 may be received, e.g., by controller 102.

At block 304, controller 102 may determine whether the detected pressure waves satisfy one or more predetermined criteria. In scenarios where the predetermined criterion is a simple audio threshold, controller 102 often may determine itself whether the detected pressure waves satisfy the audio threshold. However, if controller 102 is not capable of such analysis, then controller 102 may provide a signal representative of the detected pressure waves to one or more remote devices (e.g., lighting system bridge 220, smart phone 222, tablet computer 224, remote server, the cloud, etc.) capable of performing such analysis, and may receive a response that indicates whether the criterion is satisfied. Similarly, in scenarios where the predetermined criterion is a one or more predetermined pressure wave profiles, unless controller 102 has the computing resources to perform the analysis itself, in various embodiments, it may stream a signal representative of the detected pressure waves to a remote computing device. The remote computing device may provide, in response, a notification of whether a predetermined pressure wave profile is satisfied, or may identify which of a plurality of pressure wave profiles is satisfied. In some embodiments, controller 102 may also stream the signal to a remote device such as smart phone 222 or tablet computer 224, so that a user can listen to the detected pressure wave remotely.

If at block 304, the predetermined criterion is not satisfied, then method 300 may proceed back to the start and the detected pressure waves may be ignored. However, if the predetermined criterion is satisfied, then at block 306, controller 102 may transmit, e.g., using communication interface 108, notification that the predetermined criterion has been met to one or more remote devices, such as follower lighting units, lighting system bridge 220, smart phone 222 and/or tablet computer 224.

In some embodiments, at block 308, controller 102 may selectively energize one or more LEDs 104. In some embodiments where lighting unit 100 includes multiple pressure wave sensors 106, or where multiple co-located lighting units 100 are each equipped with a pressure wave sensor 106, a location of a pressure wave even may be determined, e.g., by using techniques such as active or passive acoustic location and/or triangulation (e.g., sonar). In such embodiments, controller 102 may be configured, e.g., by user, to energize one or more LEDs 104 and direct the emitted light in a direction of the detected pressure wave event, e.g., using optical elements such as collimators, lenses, light tubes, and other similar elements. In some embodiments, at block 310, controller 102 may selectively emit sound from speaker 114. For example, if lighting unit 100 is near a baby's crib, controller 102 may cause speaker 114 to emit a lullaby. As with the light, in some embodiments, speaker 114 may be movable, and may be directed toward the origin of a pressure wave event.

Figure 4:
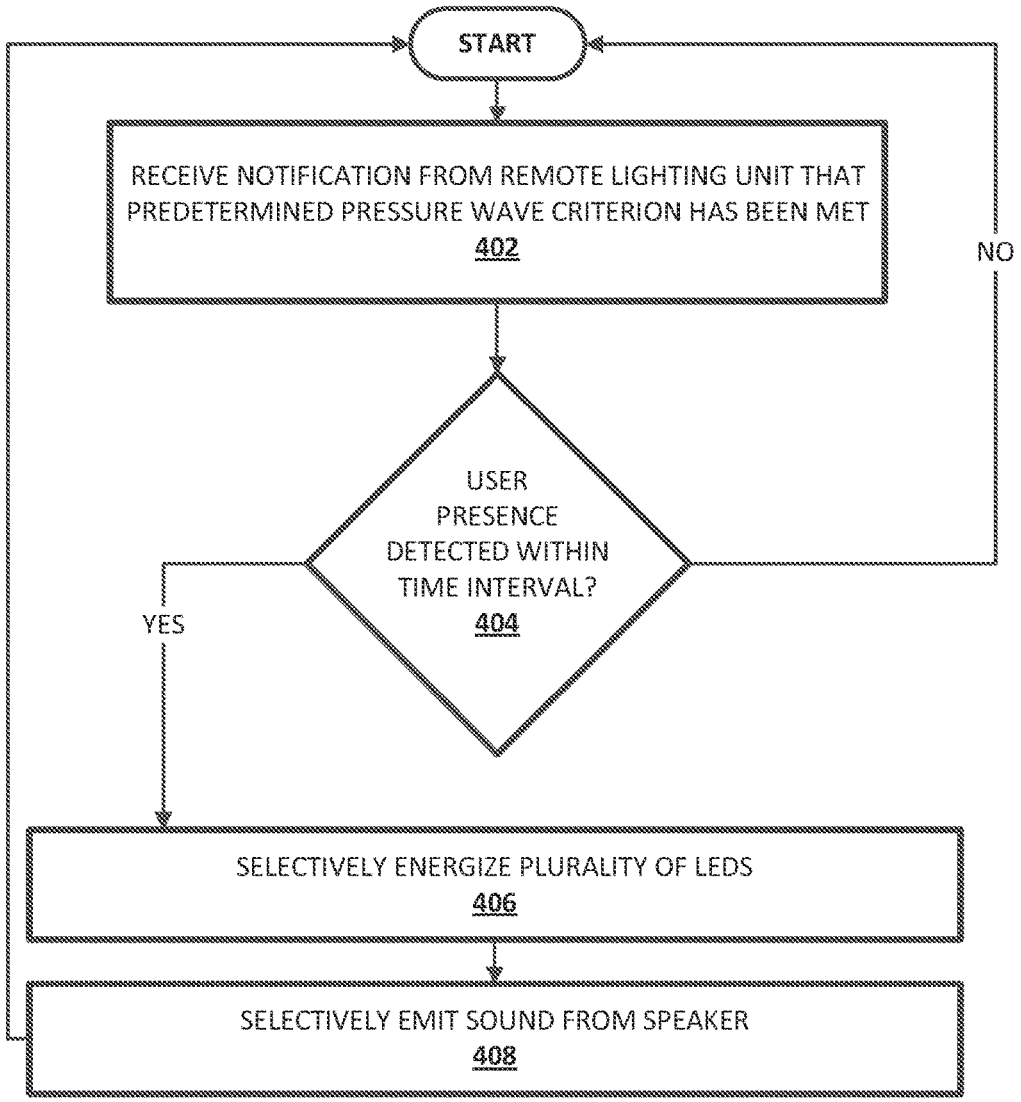
FIG. 4 depicts an example method of operating a lighting unit as a "follower," in accordance with various embodiments.

FIG. 4 depicts another method 400 that may be implemented by lighting unit 100 when acting as a "follower," in accordance with various embodiments. At block 402, controller 102 may receive, e.g., via communication interface 108 from a remote lighting unit (or lighting system bridge 220 in some cases), notification that a predetermined pressure wave criterion has been satisfied by pressure waves detected, e.g., by that remote lighting unit or another remote lighting unit. At block 404 it may be determined whether a user is present or has been present within a predetermined time interval (e.g., the last five minutes, ten minutes, hour, day, etc.).

If the answer at block 404 is no, method 400 may proceed back to its start and follower lighting unit 100 may not act in response to the notification. In some embodiments, if no lighting unit in a lighting system has detected a user presence sufficiently recently, a notification may be sent, e.g., by the detecting lighting unit or lighting system bridge 220, to a smart phone (e.g., 222) or tablet computer (e.g., 224) controlled by the user. In some embodiments, the lighting unit of a plurality of lighting units that last detected a user presence may selectively energize its one or more LEDs 104 and/or emit sound through its speaker 114.

If the answer at block 404 is yes (user presence detected sufficiently recently), then at block 406, controller 102 may selectively energize one or more LEDs 104. In embodiments wherein lighting unit 100 includes speaker 114, at block 408, controller 102 may cause speaker 114 to emit audible output.

Figure 5:
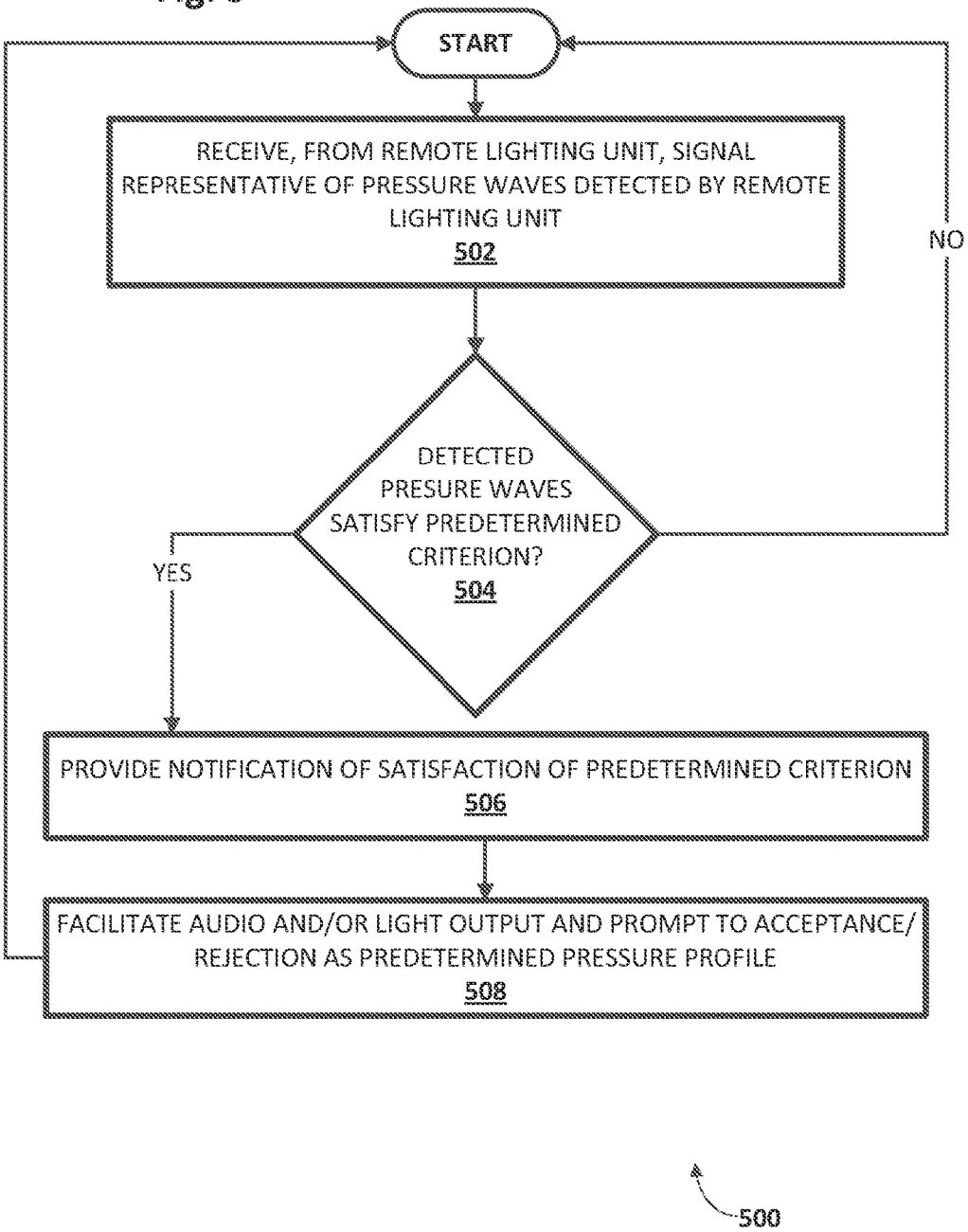
FIG. 5 depicts an example method of operating a computing device such as a lighting system bridge, smart phone, or tablet computer to determine whether one or more detected pressure waves satisfy a predetermined pressure wave profile, in accordance with various embodiments.

FIG. 5 depicts another method 500 that may be implemented by a computing device such as lighting system bridge 220, smart phone 222, tablet computer 224, or any other computing device in communication with one or more lighting units configured to practice selected aspects of the present disclosure. At block 502, a signal representative of pressure waves detected by a remote lighting unit may be received.

At block 504, it may be determined whether those detected pressure waves satisfy a predetermined criterion. For example, the device may determine whether the detected pressure waves satisfy an audio threshold or a predetermined pressure wave profile associated with a particular event.

If the answer at block 504 is no, then method 500 may proceed back to its start. If the answer is yes, however, then in some embodiments, at block 506, the device may provide notification of satisfaction of the predetermined criterion. For instance, the device may transmit notification to the detecting lighting unit that the predetermined criterion is (or is not) satisfied.

In some embodiments, at block 508, the device may additionally or alternatively enter into a "training mode" in which it facilitates playback of audio of the detected pressure waves to the user. The device may then prompt the user to accept or reject the output audio as a new predetermined pressure wave profile, subsequent satisfaction of which the user would like to be notified. In some embodiments, if the user accepts, the resulting pressure wave profile may be uploaded by the device to a clearing house of predetermined pressure wave profiles, so that other users and lighting units may utilize those profiles in the future.

In various embodiments, a user may be able to control which lighting units in a lighting system are "followers" and which are "listeners." For example, lighting system bridge 220, smart phone 222 and/or tablet computer 224 may provide a user interface that allows a user to select lighting units to perform each function. The user may exclude as followers lighting units that the user does not want to provide lighting signals in response to detected sounds. For instance, a parent may not wish for lighting units in an older child's bedroom to be selectively illuminated or to emit noise when a younger baby sibling is detected crying by another lighting unit. A user may also set a lighting unit's role to correspond to one or more contextual cues. For instance, the user may operate lighting system bridge 220 to instruct lighting units in a home office to not be followers or listeners during business hours, but to convert to followers in the evening and then listener/followers overnight. As another example, a user may set certain lighting units to be followers in response to other designated lighting units detecting user presence. For instance, a parent may wish for lights in the kitchen to become followers that notify the parent of passing traffic or an idling vehicle nearby when a child is detected by another lighting unit playing in the yard. As yet another example, a lighting unit in a child's room may, e.g., in response to being switched off at bedtime, revert to a "nightlight mode" in which it is a listener and emits soft, soothing light. As yet another example, a follower lighting unit may be configured by a user to only listen to some listener lighting units, and to ignore others.

In some embodiments, a user may be able to designate devices other than lighting units as listener devices. For instance, a user may place smart phone 222 in a baby's room and set it as a listener. When smart phone 222 detects pressure waves that satisfy a predetermined criterion (e.g., baby crying), it may notify follower lighting units, e.g., using coded light, ZigBee, WiFi, etc., so that those follower lighting units may selectively illuminate to provide notification of the baby crying to a user.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting system comprising:

a first lighting unit including one or more first LEDs, a pressure wave sensor, a first communication interface, and a first controller operably coupled with the one or more first LEDs, the pressure wave sensor, and the first communication interface, the first controller being configured to: receive a first signal from the pressure wave sensor, the first signal being representative of one or more pressure waves detected by the pressure wave sensor, determine, based on the first signal received from the pressure wave sensor, that the detected one or more pressure waves satisfy a predetermined criterion, and transmit, via the communication interface, notification that the predetermined criterion has been satisfied; and a second lighting unit including one or more second LEDs, a presence sensor, a second communication interface, and a second controller operably coupled with the one or more second LEDs, the presence sensor, and the second communication interface, the second controller being configured to: receive, from the first lighting unit via the second communication interface, said notification, and selectively energize the one or more second LEDs in response to receipt of the notification and to a signal from the presence sensor.

2. The lighting system of claim 1, wherein the predetermined criterion comprises an audio threshold.

3. The lighting system of claim 1, wherein the predetermined criterion comprises a predetermined pressure wave profile associated with a particular event.

4. The lighting system of claim 3, wherein the predetermined pressure wave profile is associated with a baby crying.

5. The lighting system of claim 3, wherein the predetermined pressure wave profile is associated with actuation of a doorbell.

6. The lighting system of claim 3, wherein the first controller is further configured to:

stream another signal representative of the detected pressure wave to a remote computing device via the first communication interface, and receive, from the remote computing device via the first communication interface, an indication that the first signal from the pressure wave sensor satisfies one or more predetermined pressure wave profiles.

7. The lighting system of claim 1, wherein the pressure wave sensor comprises an ultrasonic sensor.

8. The lighting system of claim 7, wherein the predetermined criterion comprises an ultrasonic threshold.

9. The lighting system of claim 1, further comprising a second presence sensor coupled with the first controller, wherein the first controller is further configured to selectively energize the one or more first LEDs responsive to the determination that the detected one or more pressure waves satisfy the predetermined criterion and to a second signal from the second presence sensor.

10. The lighting system of claim 1, wherein the first controller is further configured to transmit the notification to at least one smart phone or tablet computer.

11. The lighting system of claim 10, wherein the notification comprises a short message service (SMS) message.

12. The lighting system of claim 1, wherein the first controller is further configured to cause a time-stamped entry to be stored in an event log in response to the determination that the predetermined criterion is satisfied.

13. The lighting system of claim 1, wherein the predetermined criterion comprises a predetermined pressure wave profile associated with indoor noise.

14. The lighting system of claim 1, further comprising a speaker, wherein the first controller is further configured to cause the speaker to emit audio output responsive to the determination that the predetermined criterion is satisfied.

15. A lighting unit comprising:

one or more LEDs;

presence sensor;

a communication interface; and a controller operably coupled with the one or more LEDs, the presence sensor, and the communication interface, the controller configured to:

receive, from a remote lighting unit via the communication interface, notification that a predetermined criterion has been satisfied by one or more pressure waves detected by the remote lighting unit;

selectively energize the one or more LEDs in response to receipt of the notification and to a signal from the presence sensor, receive, from another remote lighting unit via the communication interface, a signal representing one or more pressure waves detected by the another remote lighting unit; and determine, using pattern matching, that the received signal corresponds to a predetermined pressure wave profile.

16. The lighting unit of claim 15, wherein the controller is further configured to selectively energize the one or more LEDs in response to a determination that the lighting unit is a last lighting unit of a plurality of lighting units to receive the signal from the presence sensor.

17. A method comprising:

receiving a signal representative of one or more pressure waves;

determining that the one or more pressure waves represented by the signal satisfy a predetermined criterion;

providing notification of the determination;

selectively energizing one or more LEDs in response to receipt of the notification and to a second signal from a presence sensor;

facilitating audio playback of the pressure wave to a user and rendition of output that prompts the user to accept or reject the pressure wave as a predetermined pressure wave profile.

18. The method of claim 17, wherein providing the notification comprises transmitting the notification to a smart phone or tablet computer operated by a user.

* * * * *